United States Patent [19]

Jennings

[11] 3,934,678

[45] Jan. 27, 1976

[54] FLOW MONITOR FOR CIRCULATING LUBRICATION SYSTEMS

[75] Inventor: Lewis C. Jennings, Boylston, Mass.

[73] Assignee: Morgan Construction Company, Worcester, Mass.

[22] Filed: Mar. 4, 1974

[21] Appl. No.: 447,900

[52] U.S. Cl. ..... 184/103 R; 184/1 C

[51] Int. Cl.[2] ..... F01M 11/12

[58] Field of Search ..... 184/103 R, 103 A, 1 C, 184/6; 137/551; 73/194, 290, 328; 116/114; 109/38; 210/535, 86, 95, 168

[56] References Cited

UNITED STATES PATENTS

| | | | |
|---|---|---|---|
| 1,017,189 | 2/1912 | Turnage | 184/103 A |
| 1,026,309 | 5/1912 | Hackett | 73/328 X |
| 2,659,068 | 11/1953 | Erickson et al. | 210/86 UX |
| 3,500,962 | 3/1970 | Kocher | 184/103 R |

*Primary Examiner*—Richard C. Pinkham
*Assistant Examiner*—William R. Browne
*Attorney, Agent, or Firm*—Thompson, Birch, Gauthier & Samuels

[57] ABSTRACT

An apparatus for detecting abnormal gains or losses in the amount of liquid lubricant being circulated through a lubrication system of the type having a pressurized side for delivering the lubricant from a main receiving tank to the equipment being lubricated, and an unpressurized drain side for returning the lubricant from the equipment to the receiving tank. The apparatus is located on the drain side of the system, and includes an indicating tank having a cross-sectional area substantially smaller than that of the main receiving tank. The lubricant is returned from the equipment being lubricated to the indicating tank, which is in turn drained into the main receiving tank through a drain line which has a metering valve adjusted to maintain a given operating level in the indicating tank during normal operation of the system. A level indicator generates a warning signal when the liquid level in the indicating tank undergoes an abnormal change from said given operating level.

6 Claims, 2 Drawing Figures

FLOW MONITOR FOR CIRCULATING LUBRICATION SYSTEMS

DESCRIPTION OF THE INVENTION

Figure 1:
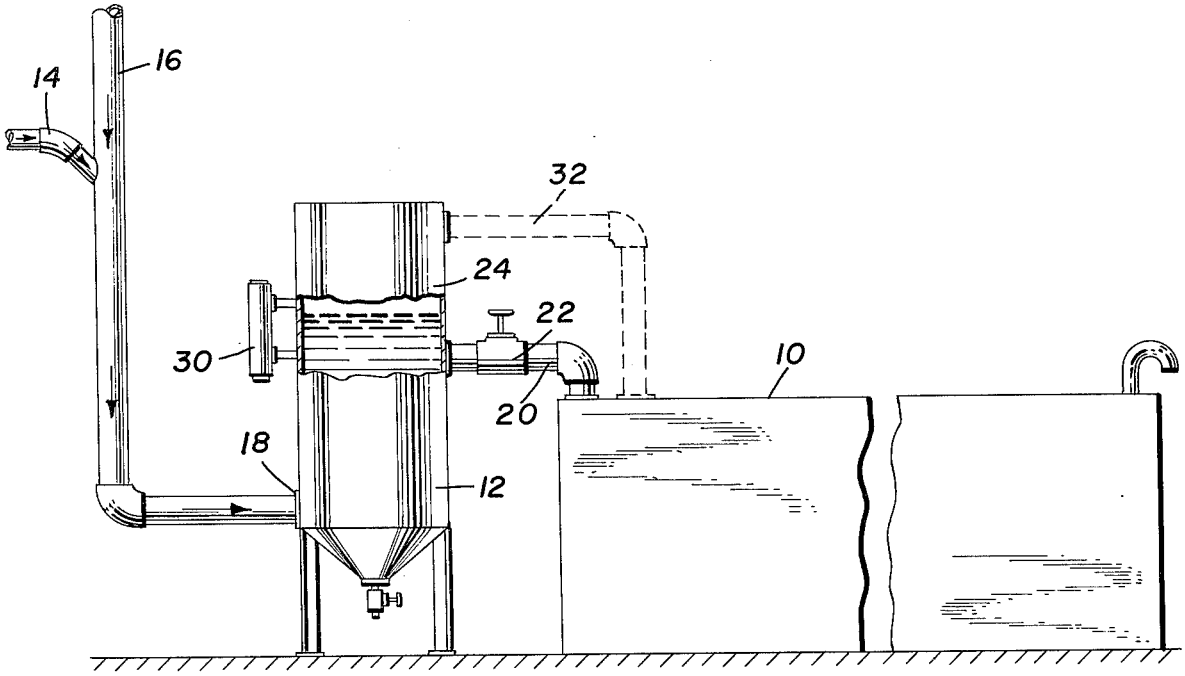

This invention relates generally to circulating lubricating systems, and is concerned in particular with a novel and improved means for rapidly detecting abnormal gains or losses in the amount of liquid lubricant being circulated through the unpressurized drain sides of such systems. The invention is particularly suited for, although not limited in use to, circulating oil systems for oil film bearings of the type employed in rolling mills.

Conventional circulating oil systems normally include suitable alarm devices installed on the pressure side of the system to guard against the possibility of equipment damage should serious oil leakage or loss of pressure occur. Leakage or contamination of the lubricant on the unpressurized drain side of such systems is normally detected by monitoring the level of liquid in the main receiving tank into which the lubricant is drained after being applied under pressure to the equipment being lubricated. Experience has indicated, however, that it is difficult to establish a normal operating level for the lubricant in the main receiving tank. Moreover, because of the large cross-sectional area of the receiving tank, abnormal changes in the level of liquid contained therein occur slowly and are thus not rapidly indicative of either leakage or contamination of the liquid lubricant. Hence, with conventional arrangements, there exists the possibility of extensive loss or contamination of the lubricant before the problem is noticed and appropriate remedial action is taken by operating personnel. Apart from being extremely costly, loss of the lubricant into streams, ponds, etc. creates ecological problems. Contamination of the lubricant can of course be damaging to either the lubricant or the equipment being lubricated.

It is, accordingly, an object of the present invention to avoid the problems and difficulties outlined above by providing a novel and improved means for detecting abnormal gains or losses in the amount of lubricant being circulated through the unpressurized drain sides of circulating lubricating systems. In the preferred embodiments of the invention to be hereinafter described in greater detail, this is accomplished by draining the lubricant from the equipment being lubricated into an indicating tank having a cross-sectional area substantially smaller than that of the system's main receiving tank. The indicating tank is in turn connected to the main receiving tank by a drain line which has a metering valve adjusted to maintain a given operating level in the indicating tank during normal operation of the system. A level indicator generates a warning signal when the liquid level in the indicating tank undergoes an abnormal change from the established operating level. Because the cross-sectional area of the indicating tank is substantially less (preferably on the order of 1/5 to 1/20) that of the main receiving tank, the response time of the level indicator is correspondingly shortened and thus operating personnel are provided with a more rapid indication of any leakage and/or contamination in the unpressurized drain side of the system.

Figure 2:
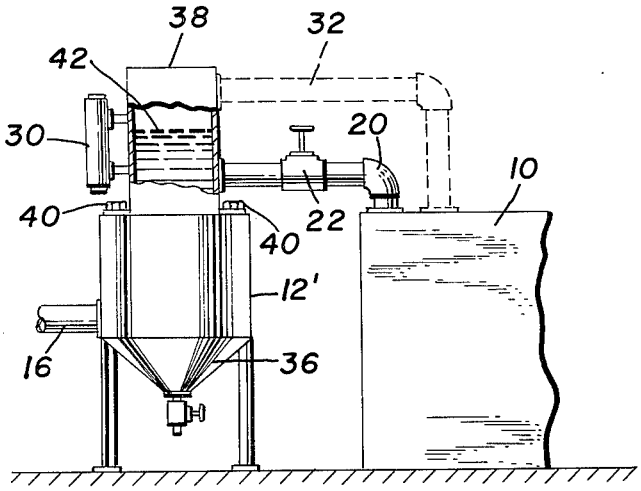

These and other objects and advantages of the present invention will become more apparent as the description proceeds with the aid of the accompanying drawings, wherein:

FIG. 1 is a schematic view of a portion of the unpressurized drain side of a circulating lubricating system embodying the concepts of the present invention; and, FIG. 2 is a schematic illustration of an alternate embodiment of the indicating tank.

Referring now to the drawings wherein like numbers designate like parts throughout the several views, and with initial reference to FIG. 1, there is shown at 10 the main receiving tank of a circulating lubricating system of the type employed to circulate oil to oil film bearings in a rolling mill. The dimensions and capacities of such tanks will of course vary depending on the requirements of a particular installation. By way of example, however, and for purposes of the following discussion, it will be assumed that the tank 10 has a cross-sectional area of 300 square feet and a capacity of 20,000 gallons.

An indicating tank 12 is shown at a position adjacent to the main receiving tank 10. Lubricating oil is drained from the equipment being lubricated through lines 14 and 16, the latter being connected as at 18 to the lower portion of the indicating tank 12. The indicating tank 12 is connected by means of a drain line 20 to the main receiving tank 10, the latter being vented in a conventional manner as at 21. An adjustable metering valve 22 is located in the drain line 20.

During normal operation of the system, the metering valve 22 is adjusted to equate the flow of lubricant being drained from the indicating tank 12 through line 20 to the flow of lubricating oil being received into the indicating tank through line 16, thereby maintaining the lubricant contained in the indicating tank at a given level as at 24.

A level indicator 30 is connected to the indicating tank 12 and functions as a means for measuring changes in the level of liquid contained therein. The level indicator 30 may be of any known conventional type, for example model 249B "Level-Trol" manufactured by Fisher Controls Company of Marshalltown, Iowa, USA.

Any change in the measured level is converted by the indicator 30 to a rotary motion output, which in turn may then be converted by another commercially available control (not shown), such as for example the Fisher Type 2340 electronic transmitter, to a proportional electrical signal. The signal is then used to actuate an appropriate alarm.

As previously indicated, the cross-sectional area of the indicating tank 12 is substantially less than that of the main tank 10. In the embodiment herein under consideration, indicating tank 12 has a cross-sectional area of 15 square feet, or 1/20 of that of the main tank 10. Thus, when a change is experienced in the volume of liquid being drained into the indicating tank 12, the rate at which the level 24 will fluctuate will be 20 times as fast as the rate at which the level of liquid in the main tank 10 would fluctuate in a conventional system where the returning liquid is drained directly to the main tank. Accordingly, the response time of the level indicator 30, which as previously indicated is employed to generate an alarm signal when abnormal fluctuations in the flow of returning liquid are experienced, will be 20 times as fast as the signal generated by level indicators which are positioned on the main receiving tank in accordance with conventional practice.

The faster reaction time made possible by the present invention is of substantial importance when, for example, leakage occurs on the return side of the system.

Under these circumstances, operating personnel receive an early indication of this problem and are thus able to take prompt remedial action. The same holds true when the volume of returning liquid undergoes an abnormal increase, as for example when the lubricating oil is being contaminated by cooling water. Here again, operating personnel are given a prompt indication of this condition and are thus able to take remedial action before the lubricating oil undergoes extensive contamination. In the event that contamination occurs at a rate such that the indicating tank is filled before appropriate remedial action is taken by operating personnel, a high level emergency by-pass line 32 is provided above line 20 to drain the indicating tank into the main receiving tank 10. The line 32 also serves as a means of handling any overflow caused by an improper adjustment of valve 22.

Referring now to FIG. 2, an alternate embodiment of an indicating tank is shown at 12' comprising a base section 36 to which is connected the line 16. The base section 36 is suitably adapted to have interchangeably mounted thereon one of several upper tank sections 38 having different cross-sectional areas. Each upper tank section may be secured in place by any conventional means, such as for example the collar and bolts indicated typically at 40.

A drain line 20 and an emergency by-pass line 32 connects the upper tank section 38 to the main receiving tank 10, and a metering valve 22 is again employed to equate the flow through lines 20 and 16 so as to maintain a liquid level 42 in the upper tank section 38. A level indicator 30 is again employed to monitor fluctuations in the level of liquid in the upper tank section 38. This embodiment thus functions exactly like the embodiment shown in FIG. 1, the only difference being that the indicating tank 12' is divided into a base section 36 and an upper tank section 38. This construction enables upper tank sections of different cross-sectional areas to be employed with a common base section 36, and thus affords more adaptability to installations having different sized receiving tanks.

It is my intention to cover all changes and modifications of the embodiments herein chosen for purposes of disclosure which do not depart from the spirit and scope of the invention.

I claim:

1. In an apparatus for circulating lubricating systems comprising a main receiving tank containing lubricant which is circulated through part of the system under pressure and unpressurized drain lines for returning the lubricant to the main receiving tank for recirculation, the improvement which comprises:

a. an indicating tank for receiving lubricant from said unpressurized drain lines, said indicating tank having a horizontal cross-sectional area which is substantially less than the horizontal cross-sectional area of said main receiving tank at any fluid level;

b. level indicator means for indicating the level of lubricant in the indicator tank, said level indicator means operatively connected to said indicating tank;

c. drain line means for draining lubricant by gravity flow from said indicating tank into said main receiving tank; and, d. valve means located along said drain line means for maintaining a substantially constant fluid level in said indicating tank during ordinary operating conditions.

2. The apparatus as claimed in claim 1 wherein the cross-sectional area of said indicating tank is in the range of 1/5 to 1/20 of the cross-sectional area of the main receiving tank.

3. The apparatus as claimed in claim 1 further comprising a second overflow drain pipe connecting said indicating tank to said main receiving tank.

4. The apparatus as claimed in claim 1 wherein said indicating tank is comprised of a lower base section having said piping means connected thereto, the said base section having removably mounted thereon a differently sized upper tank section, said upper tank having a cross-sectional area substantially smaller than that of the main receiving tank.

5. In a method for continuously lubricating a system comprising circulating a lubricant under pressure from a main receiving tank and returning the lubricant to said main receiving tank by means of unpressurized drain lines, the improvement which comprises:

a. draining the lubricant from said unpressurized drain lines into an indicating tank having a horizontal cross-sectional area which is substantially less than the horizontal cross-sectional area of said main receiving tank;

b. monitoring the fluid level in said indicating tank by means of a level indicator; and, c. draining the lubricant from said indicating tank into said main receiving tank by gravity flow through a drain line containing valve means for maintaining a substantially constant fluid level in said indicating tank during ordinary operating conditions.

6. The method of claim 5 wherein the ratio of the horizontal cross-sectional area of said indicating tank to that of said main receiving tank is in the range of 1/5 to 1/20.

* * * * *